US010214878B2

(12) United States Patent
Heemskerk et al.

(10) Patent No.: US 10,214,878 B2
(45) Date of Patent: Feb. 26, 2019

(54) VALVE SUBASSEMBLY HAVING AT LEAST TWO PUMP LINES FOR A PUMP

(71) Applicant: Robert Bosch GmbH, Stuttgart (DE)

(72) Inventors: Edwinus Heemskerk, Margetschoechheim (DE); Wolfgang Hupp, Hafenlohr (DE)

(73) Assignee: Robert Bosch GmbH, Stuttgart (DE)

( * ) Notice: Subject to any disclaimer, the term of this patent is extended or adjusted under 35 U.S.C. 154(b) by 279 days.

(21) Appl. No.: 15/191,204

(22) Filed: Jun. 23, 2016

(65) Prior Publication Data

US 2016/0376768 A1 Dec. 29, 2016

(30) Foreign Application Priority Data

Jun. 24, 2015 (DE) ..... 10 2015 211 704

(51) Int. Cl.
*E02F 9/22* (2006.01)
*F15B 11/16* (2006.01)

(52) U.S. Cl.
CPC ..... *E02F 9/2228* (2013.01); *E02F 9/2267* (2013.01); *E02F 9/2296* (2013.01); (Continued)

(58) Field of Classification Search
CPC ..... E02F 9/2228; E02F 9/2296; E02F 9/2267; F15B 11/16; F15B 2211/31511; F15B 2211/31541
See application file for complete search history.

(56) References Cited

U.S. PATENT DOCUMENTS 4,779,836 A 10/1988 Marklund
6,330,797 B1 * 12/2001 Kondo ..... E02F 9/2239 60/421

(Continued)

FOREIGN PATENT DOCUMENTS

DE 199 04 616 A1 8/2000
DE 10 2010 027 964 A1 10/2011

(Continued)

OTHER PUBLICATIONS

German Search Report corresponding to German Application No. DE 10 2015 211 704.9, dated Mar. 7, 2016 (German language document) (5 pages).

*Primary Examiner* — Thomas E Lazo
(74) *Attorney, Agent, or Firm* — Maginot, Moore & Beck LLP

(57) ABSTRACT

A valve subassembly includes a pump connection location, a tank connection location, and two constantly adjustable direction control valves each with first and second operating connection locations and an input connection location. A first valve group includes one direction control valve whose input is connected in parallel to two separate pump lines such that pressurized fluid is directed exclusively from the two pump lines to the control connection location. The two pump lines include a maximum of a first pump line and each remaining pump line is a second pump line. The maximum one first pump line is directly connected to the pump connection location in fluid terms, and a separate constantly adjustable pump valve is associated with each second pump line. Pressurized fluid is directed from the pump connection location via the pump valve into the associated second pump line.

13 Claims, 10 Drawing Sheets

(52) U.S. Cl.
CPC ..... *F15B 11/16* (2013.01); *F15B 2211/20546* (2013.01); *F15B 2211/3052* (2013.01); *F15B 2211/30535* (2013.01); *F15B 2211/30565* (2013.01); *F15B 2211/40507* (2013.01); *F15B 2211/40515* (2013.01); *F15B 2211/413* (2013.01); *F15B 2211/41509* (2013.01); *F15B 2211/426* (2013.01); *F15B 2211/50572* (2013.01); *F15B 2211/57* (2013.01); *F15B 2211/5753* (2013.01); *F15B 2211/7142* (2013.01); *F15B 2211/781* (2013.01)

(56) References Cited

U.S. PATENT DOCUMENTS

| | | | | |
|---|---|---|---|---|
| 9,803,333 | B2 * | 10/2017 | Horii | E02F 3/425 |
| 2016/0265560 | A1 * | 9/2016 | Yoshida | E02F 9/2232 |
| 2017/0009429 | A1 * | 1/2017 | Yoshida | E02F 9/2232 |
| 2017/0009430 | A1 * | 1/2017 | Yoshida | E02F 9/2232 |

FOREIGN PATENT DOCUMENTS

| | | | |
|---|---|---|---|
| DE | 10 2012 210 799 | A1 | 1/2014 |
| DE | 10 2012 222 399 | A1 | 6/2014 |
| DE | 10 2014 204 070 | A1 | 9/2015 |
| EP | 0 791 754 | B1 | 3/2002 |

* cited by examiner

VALVE SUBASSEMBLY HAVING AT LEAST TWO PUMP LINES FOR A PUMP

This application claims priority under 35 U.S.C. § 119 to patent application no. DE 10 2015 211 704.9, filed on Jun. 24, 2015 in Germany, the disclosure of which is incorporated herein by reference in its entirety.

BACKGROUND

The disclosure relates to a valve subassembly, a drive system having such a valve subassembly, and a method for the operation thereof.

EP 791 754 B1 discloses a drive system having a valve subassembly which is provided for connection to two separate pumps. The two pumps are each directly connected in fluid terms to one of two pump lines, wherein the two pump lines each extend through the entire valve subassembly. Furthermore, there are provided a plurality of direction control valves which are each connected in parallel to the two pump lines in such a manner that pressurized fluid can flow exclusively from the pump lines to the direction control valves. In this instance, it is also impossible for pressurized fluid to be exchanged between the two pump lines. There is associated with each direction control valve an actuator whose movement direction and speed can be controlled using the direction control valve.

The advantage of the present disclosure is that the valve subassembly can be operated with a single pump. When the maximum delivery flow of the pump is not sufficient to supply all the actuators adequately with pressurized fluid, predetermined consumers may be supplied with pressurized fluid in a preferable manner or with higher priority.

SUMMARY

According to the disclosure, it is proposed that the at least two pump lines comprise a maximum of a first pump line, wherein each remaining pump line is a second pump line, wherein the maximum one first pump line is directly connected to the pump connection location in fluid terms, wherein a separate constantly adjustable pump valve is associated with each second pump line, wherein pressurized fluid can be directed from the pump connection location via the pump valve into the associated second pump line. Preferably, each second pump line is connected to the pump connection location in fluid terms only via the associated pump valve. The central position mentioned is preferably arranged between the first and the second operating position. In the central position, the input connection location is preferably blocked.

Advantageous developments and improvements of the disclosure are set out in the dependent claims.

There may be provision for the valve subassembly to have a housing in which the direction control valves are arranged beside each other in a longitudinal direction, wherein at least a second pump line extends through the housing in the longitudinal direction along all the direction control valves. The housing may be constructed as an integral valve block. However, it is also conceivable for the housing to be composed of a plurality of separate valve discs, wherein each direction control valve is received in a separate valve disc. The portions of the valve subassembly described below correspond in the last alternative mentioned to the valve discs. The direction control valves preferably have a sliding valve member which can be moved in a linear manner transversely relative to the longitudinal direction.

There may be provision for there to be provided precisely two pump lines which extend through the housing in the longitudinal direction along all the direction control valves. The two pump lines may be a first and a second pump line. However, it is also conceivable for two second pump lines to be provided. This is the simplest embodiment of the disclosure.

There may be provision for the first pump line to extend through the housing from a central portion in the longitudinal direction along all the direction control valves at that location, wherein another second pump line extends through the housing from the central portion counter to the longitudinal direction along all the direction control valves at that location. With this embodiment, with respect to the previous embodiment, a finer differentiation of the supply priorities of the different actuators is possible. In both embodiments, the portions of the valve subassembly which are associated with the actuators can be used in identical form.

There may be provision for a second valve group to comprise those direction control valves in which the input connection location is connected in fluid terms to a single pump line. Each direction control valve belongs either to the first or to the second valve group. It is conceivable for all the direction control valves to belong to the first valve group.

There may be provision for at least a portion of the direction control valves of the second valve group to have a load tapping location, wherein the load tapping location in the first operating position is connected in fluid terms to the first operating connection location, wherein the load tapping location is connected in fluid terms in the second operating position to the second operating connection location, wherein the load tapping location is either blocked in the central position or connected in fluid terms to one of the at least one tank connection location(s). Preferably, there is provided a separate control return line which is connected to a separate tank connection location. It is conceivable for the load tapping location to be connected in fluid terms in the central position to the control return line.

There may be provision for there to be associated with each load tapping location a pressure balance which is connected in fluid terms between the respective input connection location and the respective pump channel, wherein the pressure at the load tapping location acts on the pressure balance in the manner of an adjustment. Preferably, the pressure balance controls the difference from the pressure at the load tapping location and another pressure, which is extremely preferably tapped in the supply, to a predetermined value.

There may be provision for the load tapping location to be connected to an associated constantly adjustable pressure reduction valve. By means of adjustment of the pressure reduction valve, the force with which the associated actuator operates can be influenced.

There may be provision for there to be associated with at least one direction control valve of the second valve group a current limitation valve which is connected in fluid terms between the respective input connection location and the respective pump line. An excessive amount of pressurized fluid is thereby prevented in a simple manner from being supplied to the associated actuator, which could lead to damage to the mentioned actuator.

There may be provision for there to be associated with at least one direction control valve of the first valve group a first and a separate second non-return valve, which are connected in fluid terms between the input connection location and an associated pump line, respectively. A first orifice may be connected in series in fluid terms to the first and/or the second non-return valve. The first and the second non-return valve are preferably installed in such a manner that pressurized fluid can be directed exclusively from the two respective pump lines to the control connection location, wherein a fluid exchange between the two respective pump lines is prevented.

There may be provision for the input connection locations of two direction control valves of the second valve group to be connected to each other in fluid terms via a second orifice. The respective direction control valves preferably each control an associated hydraulic motor, which is extremely preferably installed in the left or the right travel mechanism of a mobile operating machine. The second orifice causes the production during straight-line travel of a very small deviation from the ideal linear travel movement. The second orifice preferably has a constant flow resistance.

There may be provision, during operation of a drive system having a valve subassembly according to the disclosure, for at least one pump valve to be adjusted in the direction of a smaller flow resistance when the maximum delivery flow of the pump is not sufficient to supply all the actuators with pressurized fluid in accordance with the position of the associated direction control valve or the different load pressures of the actuators with a parallel connection to the pump would lead to a standstill of the actuator with the higher load and an excess quantity of the actuator with the lower load. The direction control valves of the first valve group thereby receive more pressurized fluid than the direction control valves of the second valve group or the load pressure differences are compensated for by the pump valve and a suitable quantity distribution over the actuators is achieved. An even finer differentiation can be achieved by the above-mentioned first orifice.

Of course, the features mentioned above and those yet to be explained below can be used not only in the combination set out but also in other combinations or alone, without departing from the scope of the present disclosure.

BRIEF DESCRIPTION OF THE DRAWINGS

The disclosure is explained in greater detail below with reference to the appended drawings, in which.

DETAILED DESCRIPTION

Figure 1:
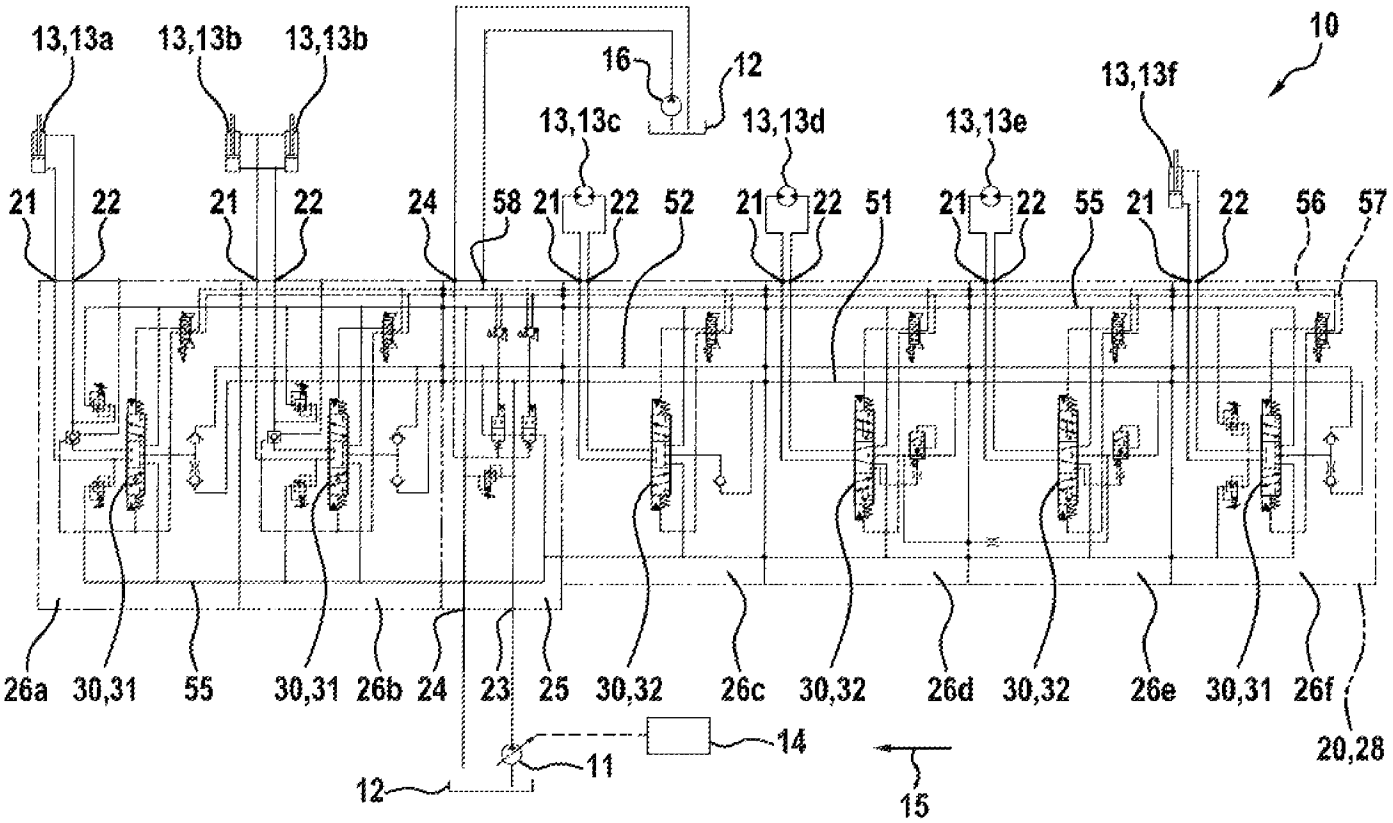
FIG. 1 shows a drive system having a valve subassembly according to a first embodiment of the disclosure.

FIG. 1 shows a drive system 10 having a valve subassembly 20 according to a first embodiment of the disclosure. The drive system 10 is, for example, an integral component of a hydraulic excavator. There are provided a plurality of actuators 13 which may be constructed as hydraulic cylinders or hydraulic motors. In the context of the hydraulic excavator mentioned, the cylinder 13*a* may be for the support, the two cylinders 13*b* which are connected in parallel for the extension arm, the hydraulic motor 13*c* for the rotary mechanism, the hydraulic motor 13*d* for the left travel mechanism, the hydraulic motor 13*e* for the right travel mechanism and the cylinder 13*f* for the shovel. The actuators 13 are each connected in fluid terms via a first and a second operating connection location 21; 22 to an associated portion 26*a*-26*f* of the valve subassembly 20.

The housing 28 of the valve subassembly 20 may be composed of a plurality of separate valve discs, wherein the first to sixth portion 26*a*-26*f* and the central portion 25 are each formed by a separate valve disc. However, it is also conceivable for the housing 28 to be constructed as an integral valve block. In the first to sixth portion 26*a*-26*f*, there is arranged in each case a single associated direction control valve 30 by means of which the movement direction and the movement speed of the associated actuator 13 can be controlled.

In the central portion 25, no direction control valve 30 is provided. At this location, the pump 11 and the tank 12 are instead connected in fluid terms to a pump connection location 23 or a tank connection location 24. The pump 11 draws pressurized fluid, in particular hydraulic oil, from the tank 12 and conveys it under pressure to the pump connection location 23. From that location, it is distributed via the central portion 25 to the first and second pump line 51; 52. The first and the second pump lines 51; 52 extend through the housing 28 in the first embodiment in the longitudinal direction 15 along all the direction control valves 30. The direction control valves 30 are in this instance arranged beside each other in a row in the longitudinal direction 15, wherein the sliding valve members thereof can be moved in a linear manner perpendicularly to the longitudinal direction 15.

Reference should further be made to the two tank lines 55 which are connected directly to the tank connection location 23 in fluid terms. The tank lines 55 extend through the housing 28 in the longitudinal direction 15 along all the direction control valves 30. Via the tank lines 55, the pressurized fluid flowing back from the actuators 13 can be directed into the tank 12. Reference may further be made to the control supply line 56 and the control return line 57 which extend through the housing 28 in the longitudinal direction 15 along all the direction control valves 30. The control oil return line 57 is in this instance connected to an additional separate tank connection location 24 which is also connected to the tank 12 in fluid terms. The control supply line 56 is supplied with pressurized fluid via a separate control supply connection location 58, for example, by means of a separate control oil pump 16.

There is further provided a control device 14 by means of which the direction control valves 30 can be actuated and by means of which the displacement volume or the delivery flow of the pump 11 can be adjusted.

The first and the separate second pump line 51; 52 primarily serve to supply the different actuators 13 with pressurized fluid with different priorities. The consumers 13*b*; 13*c*; 13*d* and 13*e* have the highest priority and are connected to the first pump line 51 without the first orifice (No. 65 in FIG. 4). The remaining actuators 13*a*; 13*f* have a lower priority. The priority of the actuator 13*b* is particularly high since it can be supplied in an unthrottled manner both via the first and via the second pump line 51; 52. The direction control valves 30 of the actuators 13*c*; 13*d*; 13*e* which are connected to only a single pump line, in this instance the first pump line 51, belong to a second valve group 32.

Figure 2:
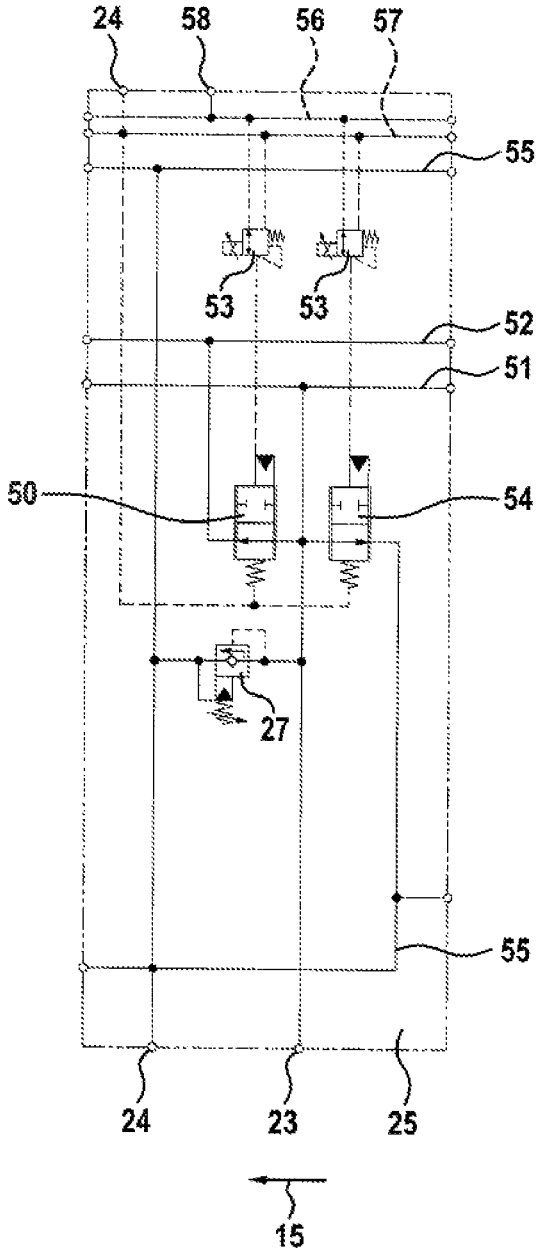
FIG. 2 shows the central portion of the valve subassembly according to FIG. 1.

FIG. 2 shows the central portion 25 of the valve subassembly according to FIG. 1. The first pump line 51 is directly connected to the pump connection location 23. The second pump line 52 is in contrast connected to the second pump line 52 in fluid terms by means of a constantly adjustable pump valve 50. When the corresponding free valve cross-section is large, a large amount of pressurized fluid flows into the second pump line 52 so that the prioritization of the actuators 13*b*; 13*c*; 13*d* and 13*e* is reduced or eliminated. By reducing the mentioned valve cross-section surface-area, the extent of the prioritization for the above-mentioned actuators 13*b*; 13*c*; 13*d* and 13*e* can be adjusted.

The pump valve 50 is in the same manner as the constantly adjustable relief valve 54 hydraulically actuated with a respectively associated pilot valve 53. The pilot valves 53 are in turn actuated electromagnetically by the control device (No. 14 in FIG. 1). Via the relief valve 54, pressurized fluid can be directed from the pump connection location 23 to the tank connection location 24. The relief valve 54 is opened when none of the actuators is moved or when all the direction control valves are located in the central position. The pressurized fluid which is conveyed by the pump then flows into the tank at a low counter-pressure. In parallel, the displacement volume of the pump is preferably reduced. As soon as one of the actuators is moved, the relief valve 54 is closed so that pressure can build up in the first and second pump lines 51; 52. The last pressure mentioned is limited by the second pressure limitation valve in an upward direction to a predetermined value. Via the second pressure limitation valve 27, pressurized fluid can be directed from the pump connection 23 to the tank connection 24.

Figure 3:
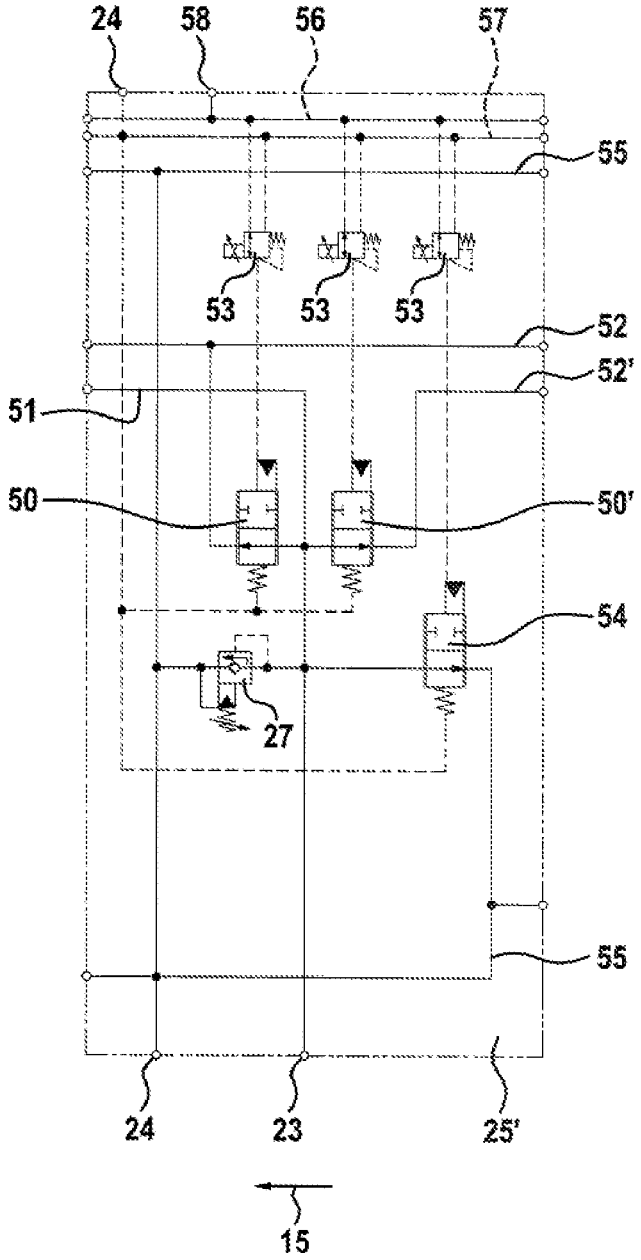
FIG. 3 shows the central portion of a valve subassembly according to a second embodiment of the disclosure.

FIG. 3 shows the central portion 25' of a valve subassembly according to a second embodiment of the disclosure. The central portion 25' replaces in this instance the central portion (No. 25 in FIG. 1) of the first embodiment, wherein the remaining first to sixth portions (Nos. 26*a*-26*f* in FIG. 1) continue to be used again in an identical manner.

In the second embodiment, the first pump line 51 no longer extends over the entire length of the housing. Instead it extends from the central portion 25' in the longitudinal direction 15 along all the direction control valves 30 at that location so that, with reference to FIG. 1, only the actuators 13*a* and 13*b* are supplied with pressurized fluid from the first pump line. In the opposite direction, an additional second pump line 52' extends through the housing. This second pump line 52' is formed in the third to the sixth portion (Nos. 26*c*-26*f*) by the same channel which in the first embodiment formed the first pump line. The only difference is that the respective channel portion 52' is now connected to the pump connection location 23 by means of an additional separate constantly adjustable pump valve 50'. It is thereby possible for the priorities of the different actuators to be differentiated in a finer manner in terms of the supply with pressurized fluid. In particular, the actuator 13*f* in FIG. 1 is now supplied via two second pump lines 52; 52' which can both be throttled with respect to the first pump line 51. The corresponding supply priority is therefore between the priority of the actuators 13*a*; 13*b* in FIG. 1 and the priority of the actuators 13*c*; 13*d*; 13*e* in FIG. 1.

Figure 4:
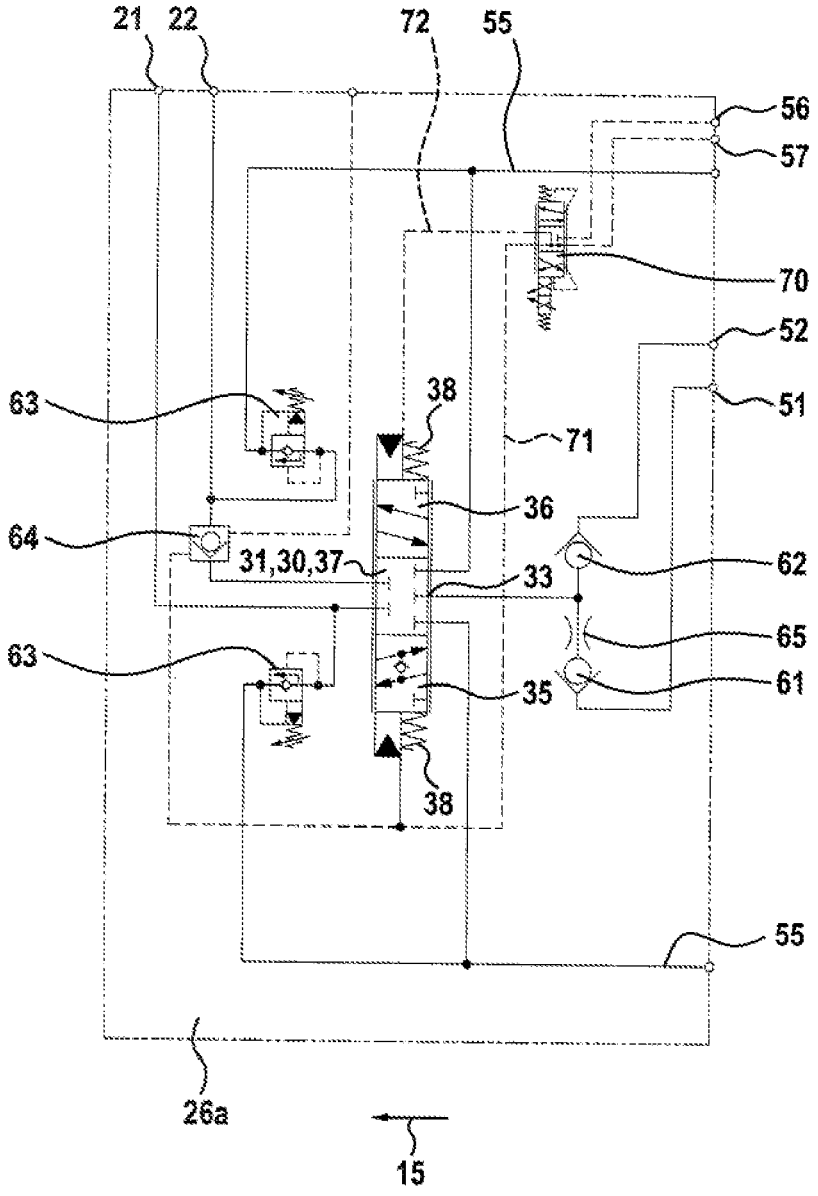
FIG. 4 shows the first portion of the valve subassembly according to FIG. 1.

FIG. 4 shows the first portion 26*a* of the valve subassembly according to FIG. 1. In this instance, it is an end portion which is fitted to the left end of the valve subassembly in FIG. 1. The first and the second pump lines 51; 52, the tank lines 55, the control supply line 56 and the control return line 57 terminate in the first portion 26*a*. In contrast, the mentioned lines 51; 52; 55; 56; 57 extend through the second to the fifth portion (Nos. 26*b*-26*e* in FIG. 1) over the entire width thereof in the longitudinal direction 15. The sixth portion (No. 26*f* in FIG. 1) forms another end portion of the valve subassembly.

The direction control valve 30 has a first and a second operating position 35; 36 and a central position 37, wherein the central position 37 is arranged between the first and the second operating position 35; 36. In the central position 37, the input connection location of the direction control valve 30 is blocked. In the first operating position 36, the input connection location 33 is connected in fluid terms to the first operating connection location 21, wherein the corresponding valve cross-section in the direction control valve 30 increases constantly during a movement from the central position 37 into the first operating position 35. In the second operating position 36, the input connection location 33 is connected in fluid terms to the second operating connection location 22, wherein the corresponding valve in the direction control valve 30 is also constantly adjustable.

The input connection location 33 is connected via a first non-return valve 61 to the first pump line 51 and in parallel therewith via a second non-return valve 62 to the second pump line 52. The non-return valves 61; 62 result in pressurized fluid being able to flow exclusively from the first or second pump line 51; 52 to the control connection location 33. It is not possible for pressurized fluid to be able to flow from the control connection location 33 back into the first or the second pump line 51; 52. It is further not possible for pressurized fluid to be exchanged between the first and the second pump line 51; 52. In place of the simple non-return valves 61; 62, it is also possible to use more complex valves which can also prevent the reflux of pressurized fluid. Purely by way of example, reference may be made to the valve according to the German Patent Application with the file reference 102014204070.1 or the valve according to U.S. Pat. No. 4,779,836 A1. As a result of the connection described above in relation to two pump lines 51; 52, the present direction control valve 30 belongs by definition to the first valve group 31.

Between the first non-return valve 61 and the input connection location 33, there is connected a first orifice 65 which results in the actuator 13*a* in FIG. 1 being supplied with pressurized fluid with a somewhat lower priority than the actuator 13*b* in FIG. 2 in which the first orifice is omitted, wherein the respective second portion (No. 26*b* in FIG. 5) is further constructed to be almost identical to the present first portion 26*a*.

In the first operating position 35, the second operating connection location 22 is connected in fluid terms to a tank line 55, wherein, in the second operating position 36, the first operating connection location 21 is connected in fluid terms to the other tank line 55. The direction control valve 30 is adjusted with one or two pressure regulation valves 70 hydraulically counter to the force of the restoring springs 38. The pressure regulation valve 70 may, for example, be constructed in accordance with DE 10 2012 222 399 A1 so that selectively one of the two adjustment pressures 71; 72 can control for both adjustment directions of the direction control valve 30. The pressure regulation valve 70 is electromagnetically actuated by the control device (No. 14 in FIG. 1). It is connected in fluid terms to the control oil supply line 56 and the control oil return line 57. The pretensioned restoring springs 38 act on the direction control valve 30 with the resilient force thereof in the direction of the central position 33.

The first and the second operating connection location 21; 22 are each connected to an associated first pressure limitation valve 63 which limits the pressure at that location in an upward direction to a predetermined value. Furthermore, the second operating connection location 22 is connected to a load retention valve 64 so that the respective actuator (No. 13*a* in FIG. 1) does not lower as a result of its inherent weight owing to leakages. The load retention valve 64 can be hydraulically unlocked, wherein it is unlocked by the adjustment pressure 71 which acts on the direction control valve 30 in the direction of the first operating position 35.

Figure 5:
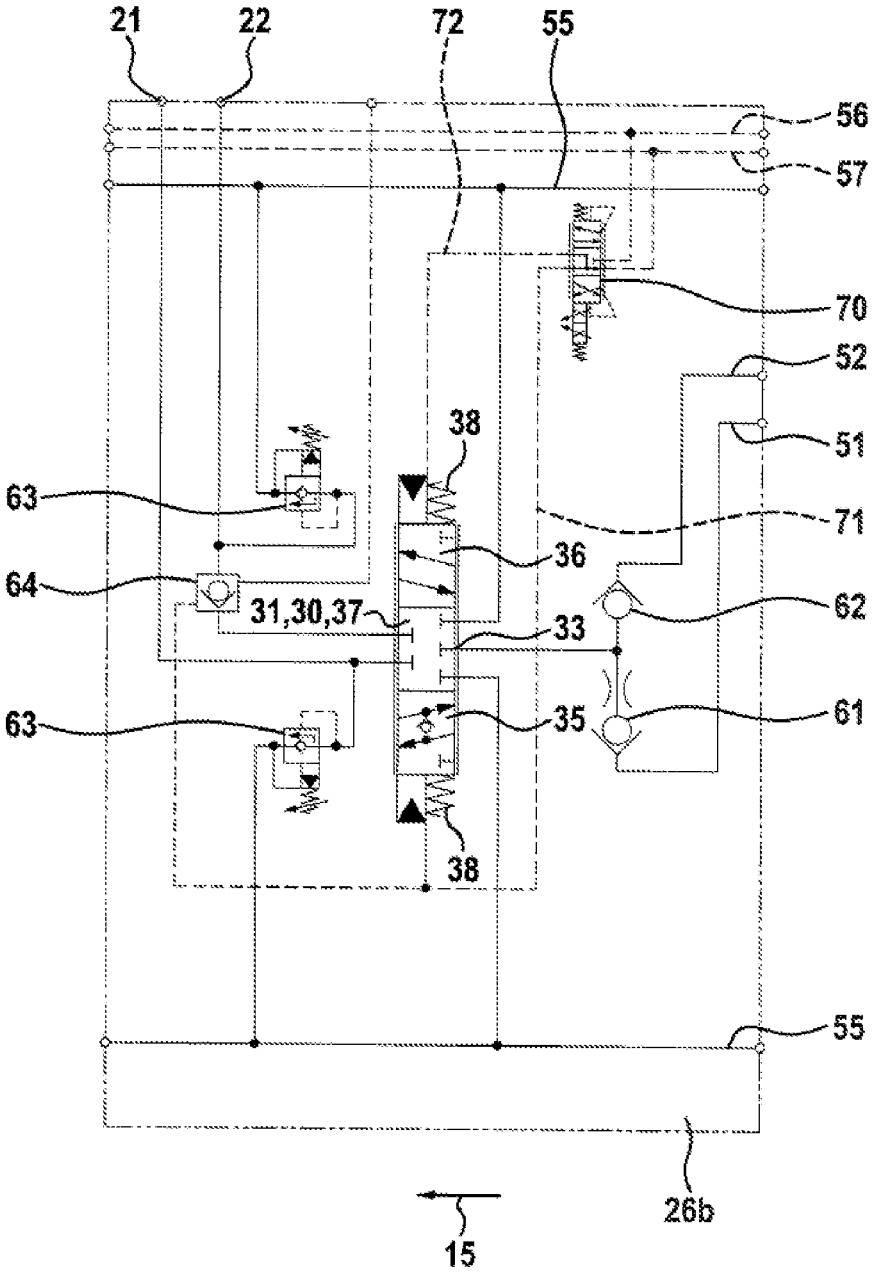
FIG. 5 shows the second portion of the valve subassembly according to FIG. 1.

FIG. 5 shows the second portion 26*b* of the valve subassembly according to FIG. 1. The second portion 26*b* is constructed in an identical manner to the first portion with the exception of the differences described below so that reference may be made in this regard to the explanations relating to FIG. 4. In FIGS. 4 and 5, identical or corresponding components are indicated with the same reference numerals.

The second portion 26*b* is constructed as an intermediate portion which can be installed between any other two portions of the valve subassembly. In FIG. 1, it is installed, for example, between the first and the central portion. The first and the second pump lines 51; 52, the tank lines 55, the control supply line 56 and the control return line 57 extend through the second portion 26*b* over the entire width thereof in the longitudinal direction 15 so that there is a fluid exchange connection with respect to the two adjacent portions. As already discussed, the first orifice (No. 65 in FIG. 4) is omitted with respect to the first portion.

Figure 6:
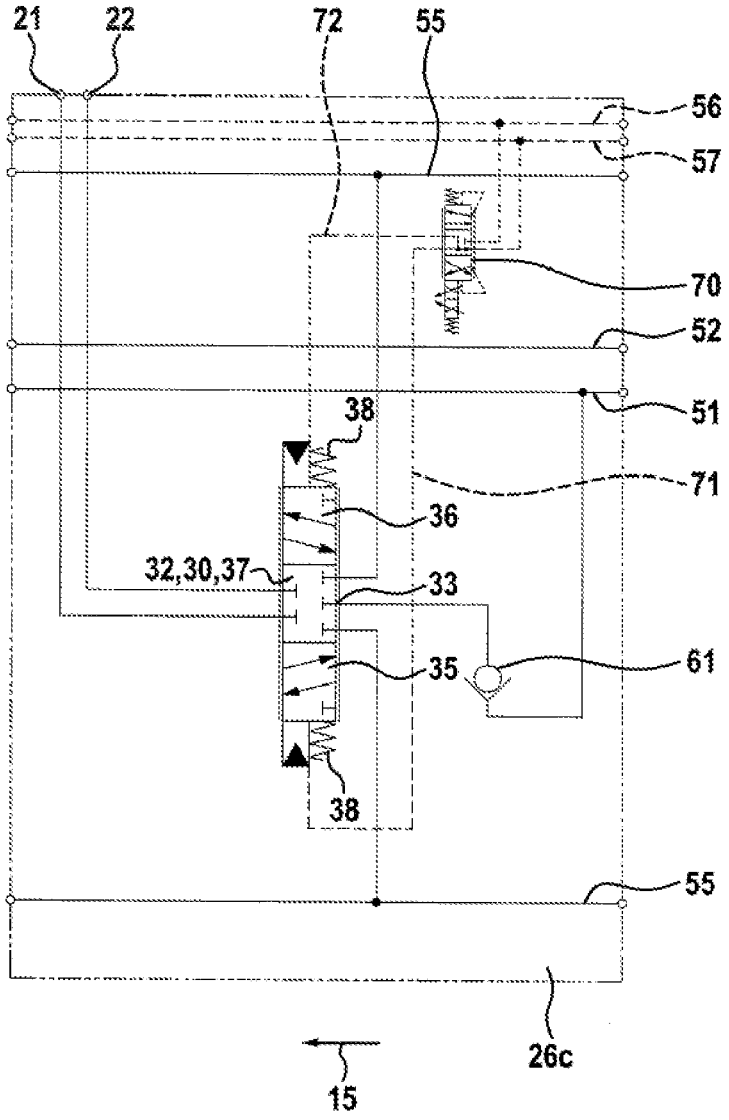
FIG. 6 shows the third portion of the valve subassembly according to FIG. 1.

FIG. 6 shows the third portion 26*c* of the valve subassembly according to FIG. 1. The third portion 26*c* is, with the exception of the differences described below, constructed in an identical manner to the second portion. Accordingly, reference may be made in this regard to the explanations relating to FIGS. 4 and 5. In FIGS. 4, 5 and 6, identical or corresponding components are given the same reference numerals.

The third portion 26*c* is in the same manner as the second portion also constructed as an intermediate portion, which can be installed between any two other portions, wherein in FIG. 1 it is installed between the central portion and the fourth portion. The present direction control valve 30 belongs by definition to the second valve group 32 since the input connection location 33 is connected only to a single pump line, that is to say, to the first pump line 51 in fluid terms. The corresponding connection is in turn carried out with a first non-return valve 61. The first orifice is preferably not present.

The third portion 26*c* is in this instance configured for the actuation of the hydraulic motor of the rotary mechanism of a hydraulic excavator. Therefore, the second pressure limitation valves and the load retention valve are omitted. The second pressure limitation valves are instead preferably located directly on the mentioned hydraulic motor.

Figure 7:
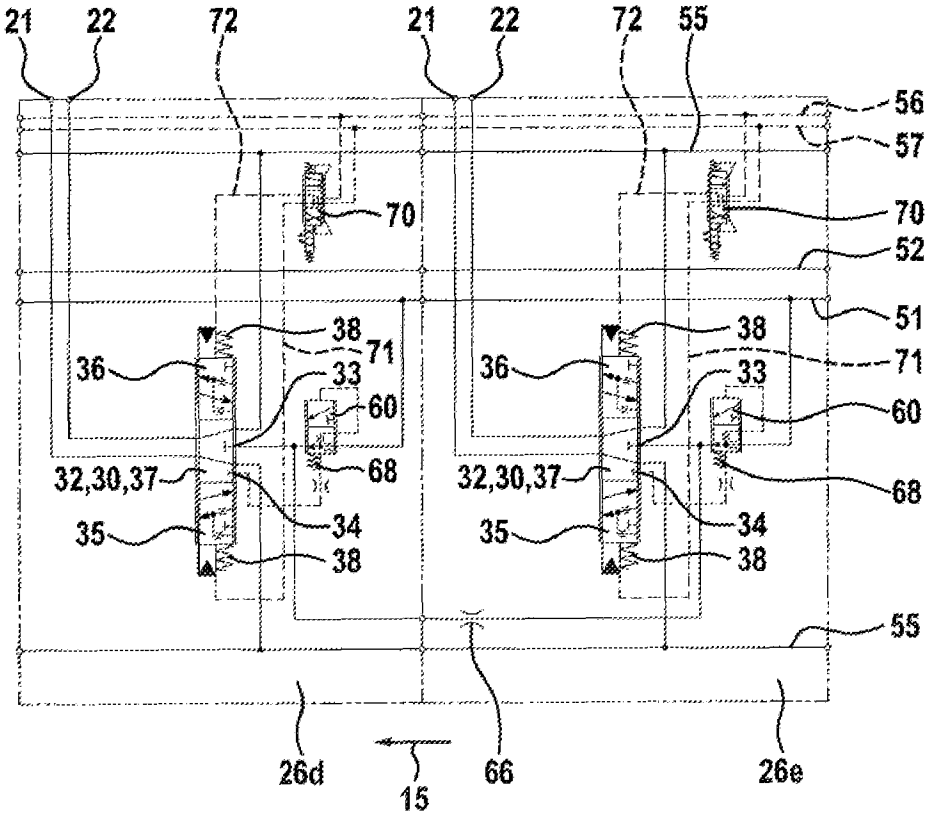
FIG. 7 shows the fourth and fifth portion of the valve subassembly according to FIG. 1.

FIG. 7 shows the fourth and the fifth portions 26*d*; 26*e* of the valve subassembly according to FIG. 1. The fourth and fifth portions 26*d*; 26*e* are with the exception of the optional second orifice 66 constructed in an identical manner to each other. They are each constructed, with the exception of the differences described below, in an identical manner to the third portion so that reference may be made in this regard to the explanations relating to FIGS. 4 to 6. In FIGS. 4 to 7, identical or corresponding components are given the same reference numerals.

The fourth and the fifth portions 26*d*; 26*e* are configured for the actuation of the hydraulic motors of the left and the right travel mechanism of a hydraulic excavator. In this instance, the specific feature arises that the pump (No. 11 in FIG. 1) can convey a significantly greater quantity of pressurized fluid than a single one of the hydraulic motors mentioned can receive. Therefore, precautions were taken so that the hydraulic motors mentioned do not become damaged as a result of excess supply with pressurized fluid. In particular, the first non-return valve is replaced by a pressure balance 60. The first pump line 51 is connected to the input connection location 33 by means of a constantly adjustable valve in the pressure balance 60. In the closure direction of the valve mentioned, the pressure balance 60 is acted on by the force of a pretensioned spring 68 and by the pressure at a load tapping location 34. In the opening direction of the valve mentioned, the pressure balance 60 is acted on by the pressure in the first pump line 61. A plurality of valves are connected in the corresponding control lines in order to damp system oscillations.

The load tapping location 34 of the present direction control valve 30 is in the first operating position 35 connected in fluid terms to the first operating connection location 21, wherein, in the second operating position 36, it is connected in fluid terms to the second operating connection location 22, wherein the load tapping location 34 is either blocked in the central position 37 or connected to the control return line 57 in fluid terms. In both operating positions 35; 36, therefore, the supply-side pressure is present at the load tapping location 34 so that the pressure balance 60 adjusts the difference between the above-mentioned pressure and the pressure in the first pump line 51 to the pressure equivalent of the spring 68. Consequently, the fluid flow to the respective actuators (No. 13*d*; 13*e* in FIG. 1) cannot increase beyond a predetermined value which is dependent on the smallest valve resistance in the direction control valve 30 and the pressure equivalent of the spring 68.

Via the second orifice 66, the input connection locations 33 of the direction control valves 30 of the fourth and fifth portions 26*d*; 26*e* are connected to each other in fluid terms. It is thereby possible, in the event of straight-ahead travel, for the left and the right travel mechanisms to move very precisely at the same speed so that the smallest possible deviation from a precisely linear travel line is produced.

Figure 8:
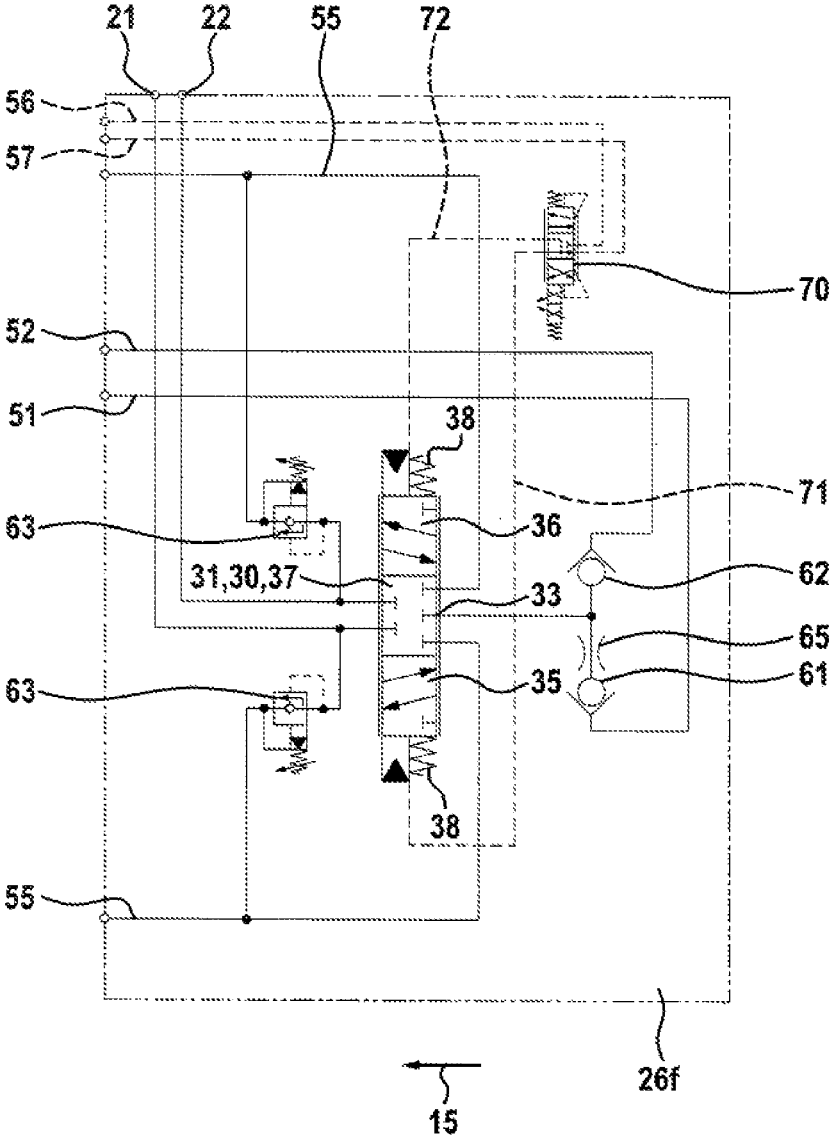
FIG. 8 shows the sixth portion of the valve subassembly according to FIG. 1.

FIG. 8 shows the sixth portion 26*f* of the valve subassembly according to FIG. 1. This is constructed, with the exception of the differences described below, in an identical manner to the first portion according to FIG. 4 so that reference may be made in this regard to the explanations relating to FIG. 4. In this instance, identical or corresponding components in FIGS. 4 and 8 are given the same reference numerals.

The sixth portion 26*f* forms the end portion, which is arranged at the end of the valve subassembly opposite the first portion. It is therefore constructed in a substantially mirror-symmetrical manner with respect to the first portion.

Figure 9:
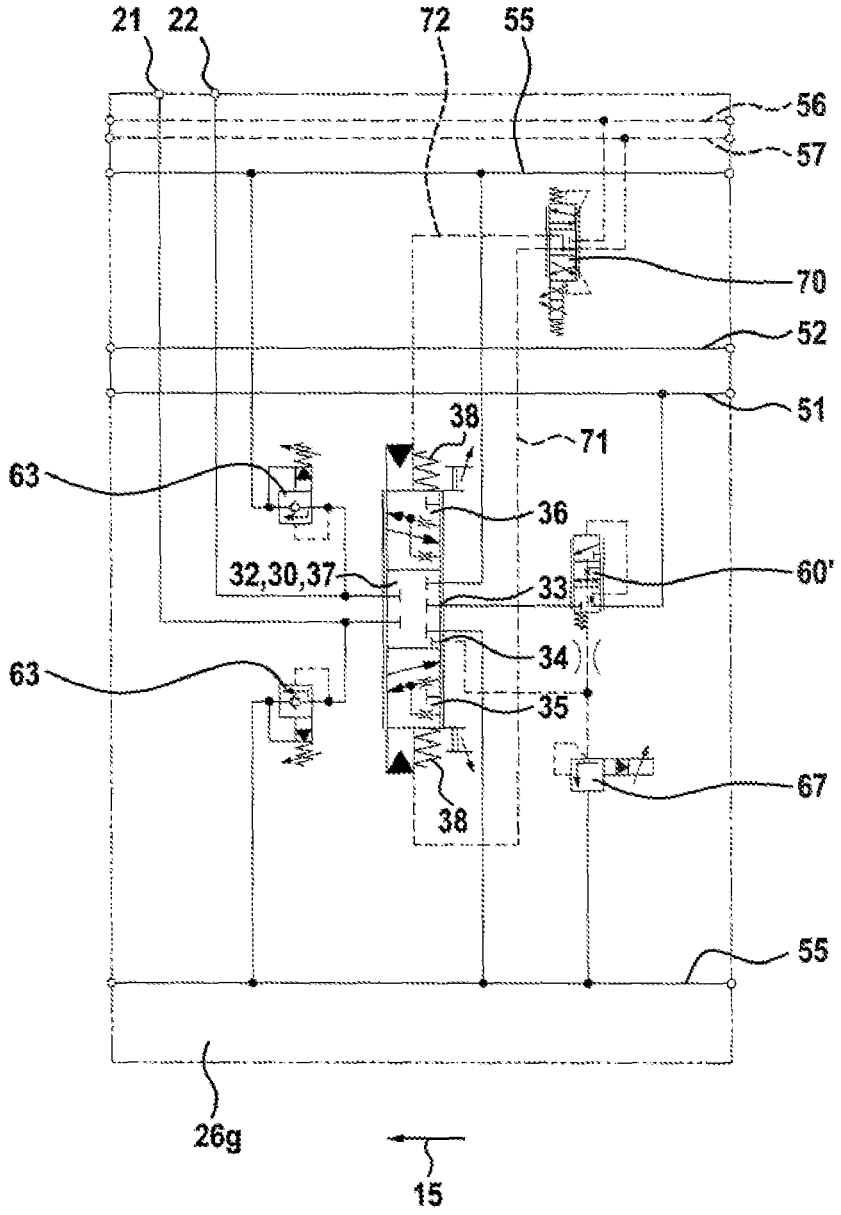
FIG. 9 shows a seventh portion which can be used together with the valve subassembly according to the first and second embodiments of the disclosure.

FIG. 9 shows a seventh portion 26*g* which can be used together with the valve subassembly according to the first and second embodiments of the disclosure. The seventh portion 26*g* is with the exception of the differences described below constructed in an identical manner to the fourth or fifth portion so that reference may be made in this regard to the explanations relating to FIGS. 4 to 7. In this instance, components which are identical or corresponding in FIGS. 4 to 7 and 9 are indicated with the same reference numerals.

The seventh portion 26*g* is configured to control any function of a hydraulic excavator which has not yet been addressed. It is constructed as an intermediate portion which can be installed between any two portions of the first or the second embodiment. The present direction control valve 30 belongs by definition to the second valve group 32 since it is supplied with pressurized fluid only from a single pump line, in this instance from the first pump line 51.

The direction control valve 30 is also provided with the load tapping location 34 which has already been set out. However, this is additionally connected to a pressure reduction valve 67. The pressure reduction valve 67 may be electromagnetically adjusted by the control device (No. 14 in FIG. 1). It brings about a selective limitation of the pressure which is applied at the load tapping location 34 and which acts on the pressure balance 60. In this instance, it should be noted that the load tapping location 34 is connected to the first or second operating connection location 21; 22 via an associated valve in the direction control valve 30 so that via the pressure reduction valve 67 only a small fluid flow flows toward the tank line 55.

The additional switching position of the pressure balance 60' with respect to the pressure balance 60 in FIG. 7 should further be noted. This position prevents the reflux of pressurized fluid from the input connection location 33 into the first pump line 51.

As a result of appropriate adjustment of the pressure reduction valve 67, the maximum force with which the actuator which is connected to the seventh portion 26*g* operates can be limited in a selective manner.

In the same manner as with the first, the second and the sixth portions, the first and the second operating connections 21; 22 are provided with a first pressure limitation valve 63 which limits the pressure at that location to a predetermined value in an upward direction.

Figure 10:
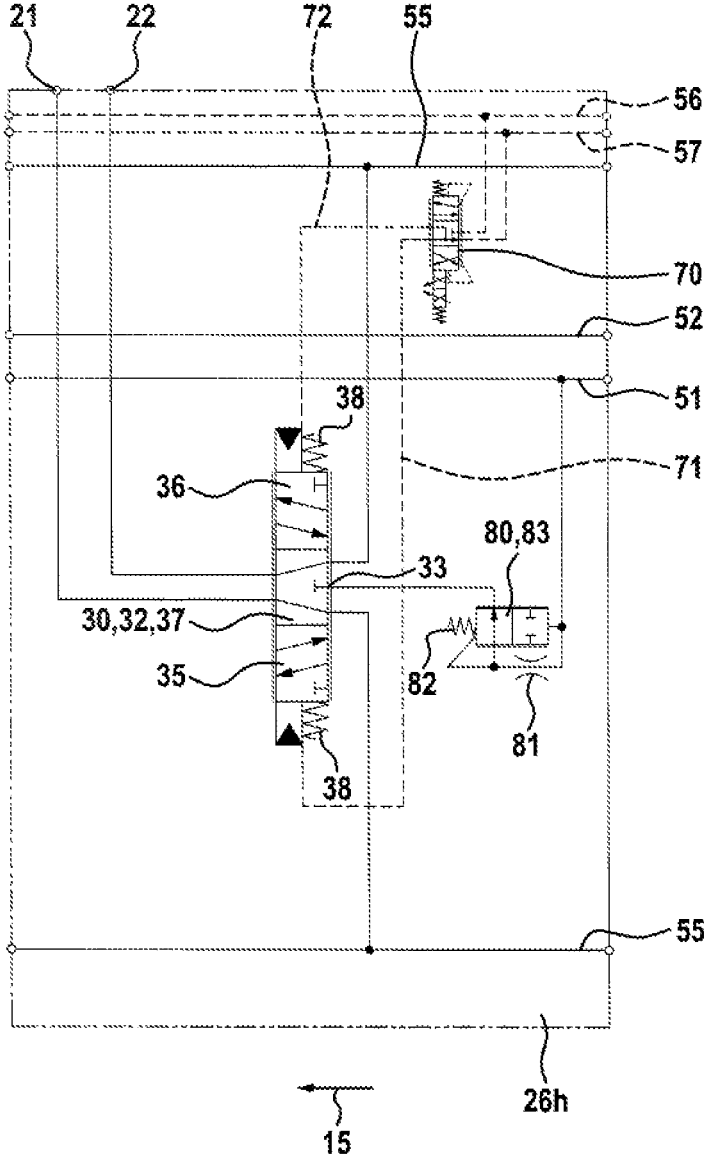
FIG. 10 shows an eighth portion which can be used together with the valve subassembly according to the first and second embodiments of the disclosure.

FIG. 10 shows an eighth portion 26*h* which can be used together with the valve subassembly according to the first and the second embodiment of the disclosure. The eighth portion 26*h*, with the exception of the differences described below, is constructed in an identical manner to the fourth and fifth portions. It is configured for the actuation of a hydraulic motor of a travel mechanism of a hydraulic excavator so that it can be used as a cost-effective replacement for the fourth or fifth portion.

The direction control valve 30 has, as in the first portion and in contrast to the fourth or fifth portion, no load tapping location. The pressure balance of the fourth or fifth portion has been replaced by a current limitation valve 80. The current limitation valve 80 comprises a fixed orifice 81 and a pressure balance 83 which is connected in series relative thereto and which is arranged in this instance downstream with respect to the orifice 81. In the closure direction, the constantly adjustable pressure balance 83 is acted on with pressure upstream of the orifice 81. In the opening direction, the pressure balance 83 is acted on by a pretensioned spring 82 and the pressure downstream of the orifice 81. The pressure equivalent of the spring 82 and the throttle resistance of the orifice 81 are selected in such a manner that the current limitation valve 80 seeks to adjust the volume flow flowing through to the maximum permissible volume flow for the connected hydraulic motor. During normal operation, however, the pump and the present direction control valve 30 are adjusted in such a manner that a smaller volume flow flows through the current limitation valve 80 so that the pressure balance 83 is completely open, wherein it does not substantially influence the control of the travel mechanism. Only when an excessive quantity of pressurized fluid exceptionally flows through the current limitation valve 80 is the adjustment function activated, and it limits the volume flow to the preselected value.

LIST OF REFERENCE NUMERALS

10 Drive system
11 Pump
12 Tank
13 Actuator
13*a* Cylinder for the support
13*b* Cylinder for the extension arm
13*c* Hydraulic motor for the rotary mechanism
13*d* Hydraulic motor for the left travel mechanism
13*e* Hydraulic motor for the right travel mechanism
13*f* Cylinder for the shovel
14 Control device
15 Longitudinal direction
16 Control oil pump
20 Valve subassembly
21 First operating connection location
22 Second operating connection location
23 Pump connection location
24 Tank connection location
25 Central portion (first embodiment)
25' Central portion (second embodiment)
26*a* First portion
26*b* Second portion
26*c* Third portion
26*d* Fourth portion
26*e* Fifth portion
26*f* Sixth portion
26*g* Seventh portion
26*h* Eighth portion
27 Second pressure limitation valve
28 Housing
30 Direction control valve
31 First valve group
32 Second valve group
33 Input connection location
34 Load tapping location
35 First operating position
36 Second operating position
37 Central position
38 Restoring spring
50 Pump valve
50' Pump valve
51 First pump line
52 Second pump line
52' Second fluid line
53 Pilot valve
54 Relief valve
55 Tank line
56 Control supply line
57 Control return line
58 Control supply connection location
60 Pressure balance
60' Pressure balance
61 First non-return valve
62 Second non-return valve
63 First pressure limitation valve
64 Load retention valve
65 First orifice
66 Second orifice
67 Pressure reduction valve

68 Spring on the pressure balance
70 Pressure regulation valve
71 First adjustment pressure
72 Second adjustment pressure
80 Current limitation valve
81 Orifice on the current limitation valve
82 Spring on the current limitation valve
83 Pressure balance of the current limitation valve

What is claimed is:

1. A valve subassembly, comprising:

a pump connection location;

at least one tank connection location; and at least two constantly adjustable direction control valves each with a first operating connection location, a second operating connection location, and an input connection location, the at least two direction control valves each having a first operating position, a central position, and a second operating position, wherein the input connection location is connected (i) in the first operating position in fluid terms to the first operating connection location and (ii) in the second operating position in fluid terms to the second operating connection location, wherein a first valve group comprises at least one direction control valve, whose input connection location is connected in parallel to two of at least two separate pump lines in such a manner that pressurized fluid is configured to be directed exclusively from the two pump lines to the input connection location, wherein a fluid exchange between the two pump lines is prevented, wherein the at least two pump lines comprise a maximum of a first pump line, and each remaining pump line is a second pump line, wherein the maximum one first pump line is directly connected to the pump connection location in fluid terms, wherein a separate constantly adjustable pump valve is associated with each second pump line, and wherein pressurized fluid is configured to be directed from the pump connection location via the pump valve into the associated second pump line.

2. The valve subassembly according to claim 1, wherein the valve subassembly has a housing in which the direction control valves are arranged beside each other in a longitudinal direction, and wherein at least a second pump line extends through the housing in the longitudinal direction along all the direction control valves.

3. The valve subassembly according to claim 2, wherein precisely two pump lines extend through the housing in the longitudinal direction along all the direction control valves.

4. The valve subassembly according to claim 2, wherein the first pump line extends through the housing from a central portion in the longitudinal direction along all the direction control valves at that location, and wherein another second pump line extends through the housing from the central portion counter to the longitudinal direction along all the direction control valves at that location.

5. The valve subassembly according to claim 1, wherein a second valve group comprises those direction control valves in which the input connection location is connected in fluid terms to a single pump line.

6. The valve subassembly according to claim 5, wherein:

at least a portion of the direction control valves of the second valve group has a load tapping location, the load tapping location in the first operating position is connected in fluid terms to the first operating connection location, the load tapping location is connected in fluid terms in the second operating position to the second operating connection location, and the load tapping location is either blocked in the central position or connected in fluid terms to one of the at least one tank connection location(s).

7. The valve subassembly according to claim 6, wherein a pressure balance is associated with each load tapping location, the pressure balance connected in fluid terms between the respective input connection location and the respective pump channel, and wherein the pressure at the load tapping location acts on the pressure balance in the manner of an adjustment.

8. The valve subassembly according to claim 6, wherein the load tapping location is connected to an associated constantly adjustable pressure reduction valve.

9. The valve subassembly according to claim 5, wherein a current limitation valve is associated with at least one direction control valve of the second valve group, the current limitation valve connected in fluid terms between the respective input connection location and the respective pump line.

10. The valve subassembly according to claim 1, wherein a first non-return valve and a separate second non-return valve are associated with at least one direction control valve of the first valve group, the first non-return valve and the separate second non-return valve are connected in fluid terms between the input connection location and an associated pump line.

11. The valve subassembly according to claim 5, wherein the input connection locations of two direction control valves of the second valve group are connected to each other in fluid terms via a second orifice.

12. A drive system, comprising:

a valve subassembly including:

a pump connection location, at least one tank connection location, and at least two constantly adjustable direction control valves each with a first operating connection location, a second operating connection location, and an input connection location, the at least two direction control valves each having a first operating position, a central position, and a second operating position, wherein the input connection location is connected (i) in the first operating position in fluid terms to the first operating connection location and (ii) in the second operating position in fluid terms to the second operating connection location, wherein a first valve group comprises at least one direction control valve, whose input connection location is connected in parallel to two of at least two separate pump lines in such a manner that pressurized fluid is configured to be directed exclusively from the two pump lines to the input connection location, wherein a fluid exchange between the two pump lines is prevented, wherein the at least two pump lines comprise a maximum of a first pump line, and each remaining pump line is a second pump line, wherein the maximum one first pump line is directly connected to the pump connection location in fluid terms, wherein a separate constantly adjustable pump valve is associated with each second pump line, and wherein pressurized fluid is configured to be directed from the pump connection location via the pump valve into the associated second pump line;

a pump; and a tank connected in fluid terms to the at least one tank connection location, wherein using the pump pressurized fluid is configured to be conveyed from the tank to the pump connection location, wherein the pump has a constantly adjustable displacement volume that is configured to be adjusted by an electronic control device in accordance with the positions of the at least two direction control valves, and wherein an actuator is connected to the pairs of first and second operating connection locations.

13. A method for operating a drive system, the drive system including a valve subassembly including a pump connection location, at least one tank connection location, and at least two constantly adjustable direction control valves each with a first operating connection location, a second operating connection location, and an input connection location, the at least two direction control valves each having a first operating position, a central position, and a second operating position, wherein the input connection location is connected (i) in the first operating position in fluid terms to the first operating connection location and (ii) in the second operating position in fluid terms to the second operating connection location, wherein a first valve group comprises at least one direction control valve, whose input connection location is connected in parallel to two of at least two separate pump lines in such a manner that pressurized fluid is configured to be directed exclusively from the two pump lines to the input connection location, wherein a fluid exchange between the two pump lines is prevented, wherein the at least two pump lines comprise a maximum of a first pump line, and each remaining pump line is a second pump line, wherein the maximum one first pump line is directly connected to the pump connection location in fluid terms, wherein at least one separate constantly adjustable pump valve is associated with each second pump line, and wherein pressurized fluid is configured to be directed from the pump connection location via the at least one pump valve into the associated second pump line, the drive system further including a pump and a tank connected in fluid terms to the at least one tank connection location, wherein using the pump pressurized fluid is configured to be conveyed from the tank to the pump connection location, wherein the pump has a constantly adjustable displacement volume that is configured to be adjusted by an electronic control device in accordance with the positions of the at least two direction control valves, and wherein an actuator is connected to the pairs of first and second operating connection locations, the method comprising:

adjusting the at least one pump valve in the direction of a smaller flow resistance when the maximum delivery flow of the pump is not sufficient to supply all the actuators with pressurized fluid in accordance with the position of the associated direction control valve.

* * * * *